US009027798B2

(12) United States Patent
Gringer et al.

(10) Patent No.: US 9,027,798 B2
(45) Date of Patent: May 12, 2015

(54) POURING ADAPTOR ASSEMBLY COMPATIBLE WITH MULTIPLE BUCKET LID CONFIGURATIONS

(71) Applicant: Allway Tools, Inc., Bronx, NY (US)

(72) Inventors: Donald Gringer, New York, NY (US); Yuan Fang Cheng, Forrest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 27 days.

(21) Appl. No.: 13/834,202

(22) Filed: Mar. 15, 2013

(65) Prior Publication Data

US 2014/0263466 A1 Sep. 18, 2014

(51) Int. Cl.
*G01F 11/10* (2006.01)
*B65D 25/48* (2006.01)
*B65D 47/06* (2006.01)

(52) U.S. Cl.
CPC ..... *B65D 25/48* (2013.01); *B65D 47/06* (2013.01)

(58) Field of Classification Search
CPC ..... B67D 7/76; B67D 7/766; B65D 25/48
USPC ..... 222/567, 568, 570, 153.1
See application file for complete search history.

(56) References Cited

U.S. PATENT DOCUMENTS

| | | | | |
|---|---|---|---|---|
| 250,276 | A | 11/1881 | Morris | |
| 1,698,403 | A | 1/1929 | Harris | |
| 2,709,540 | A | 5/1955 | Kenney | |
| 2,731,178 | A | 1/1956 | Larsson | |
| 2,765,969 | A | 10/1956 | Bennington | |
| 2,960,257 | A | 11/1960 | Sasse | |
| 3,014,621 | A | 12/1961 | Povitz | |
| 3,913,785 | A | 10/1975 | Pattershall | |
| 4,898,297 | A | 2/1990 | Wheeler | |
| 4,911,319 | A | 3/1990 | DeJean | |
| 4,993,767 | A | 2/1991 | Song | |
| 5,269,438 | A | 12/1993 | Kelsey | |
| 5,505,330 | A | 4/1996 | Nunez | |
| 5,582,321 | A | 12/1996 | Urbanczyk | |
| 5,683,009 | A | 11/1997 | King | |
| 5,853,107 | A | 12/1998 | Giwojna | |
| 5,893,489 | A | 4/1999 | Giarrante | |
| 5,913,450 | A | 6/1999 | Runkel | |
| 6,135,310 | A | 10/2000 | Svehaug | |
| 6,213,338 | B1 | 4/2001 | Cogdill | |
| 6,213,349 | B1 * | 4/2001 | Yan | 222/83 |
| 6,296,158 | B1 * | 10/2001 | Zhou et al. | 222/570 |
| 6,863,098 | B2 * | 3/2005 | Chrisco et al. | 141/286 |
| 6,896,156 | B2 | 5/2005 | McDonald | |
| 7,134,574 | B2 | 11/2006 | Braunstein et al. | |
| 7,134,576 | B2 | 11/2006 | Gringer et al. | |

(Continued)

OTHER PUBLICATIONS

Allway Tools, Soft Grip Tools for Hard Hat Jobs, 2008, p. 17.

*Primary Examiner* — Paul R Durand
*Assistant Examiner* — Jeremy W Carroll
(74) *Attorney, Agent, or Firm* — Gottlieb, Rackman & Reisman, P.C.

(57) ABSTRACT

A pouring adaptor assembly compatible with multiple bucket lid types includes a pouring tube and a threaded adaptor. The pouring tube includes an opening and an angled proximate end for steadily pouring a liquid. The threaded adaptor includes an inner thread and an outer thread, the two threads for connecting to bucket lid openings of varying widths. The pouring tube includes a tapered lower ridge for snap connecting to a bucket lid having a non-threaded opening.

10 Claims, 5 Drawing Sheets

(56) References Cited

U.S. PATENT DOCUMENTS

| | | | | |
|---|---|---|---|---|
| 7,959,034 | B2 * | 6/2011 | Faaborg et al. | 222/109 |
| 8,087,554 | B2 | 1/2012 | Gringer et al. | |
| 2004/0065698 | A1 | 4/2004 | Braunstein | |
| 2004/0232175 | A1 * | 11/2004 | deCler et al. | 222/567 |
| 2007/0194047 | A1 * | 8/2007 | Tauber et al. | 222/109 |
| 2012/0325858 | A1 * | 12/2012 | MacDonald et al. | 222/189.07 |
| 2013/0146621 | A1 * | 6/2013 | Fox et al. | 222/566 |
| 2014/0103070 | A1 * | 4/2014 | Muehlhausen et al. | 222/153.09 |

* cited by examiner

FIG. 1
Prior Art
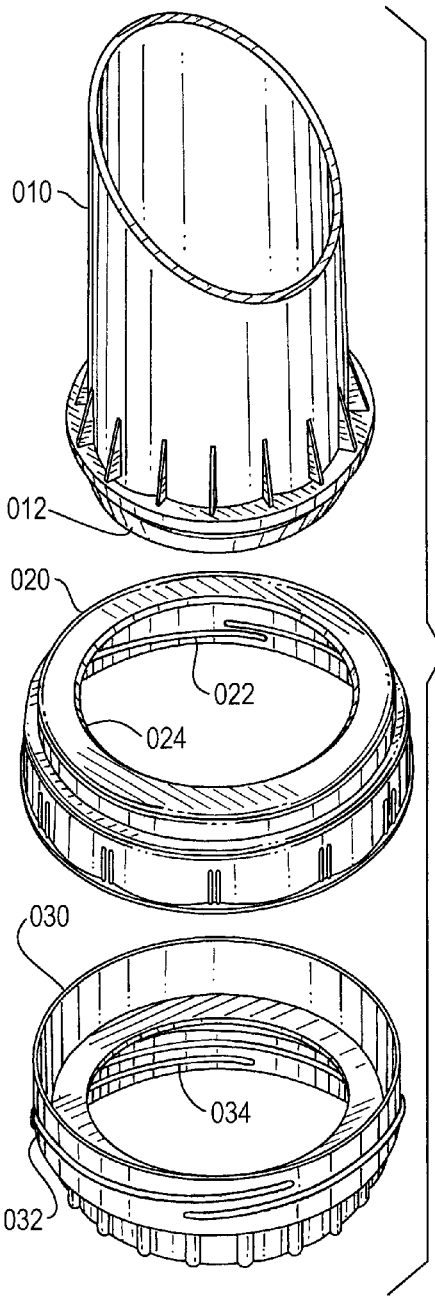
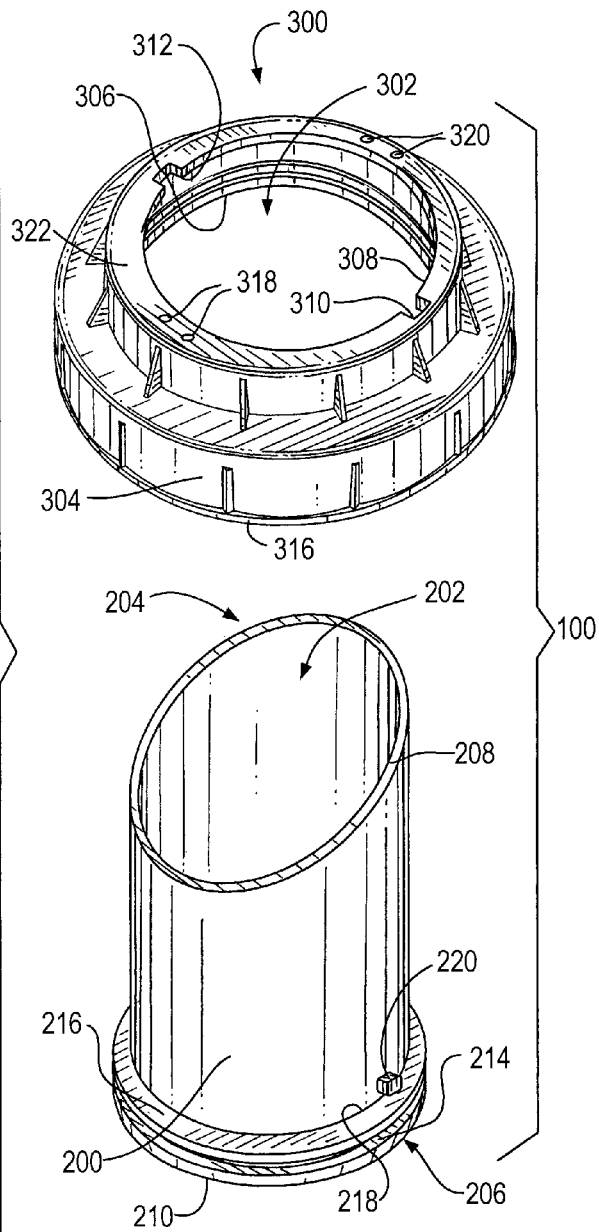
FIG. 2

FIG. 9
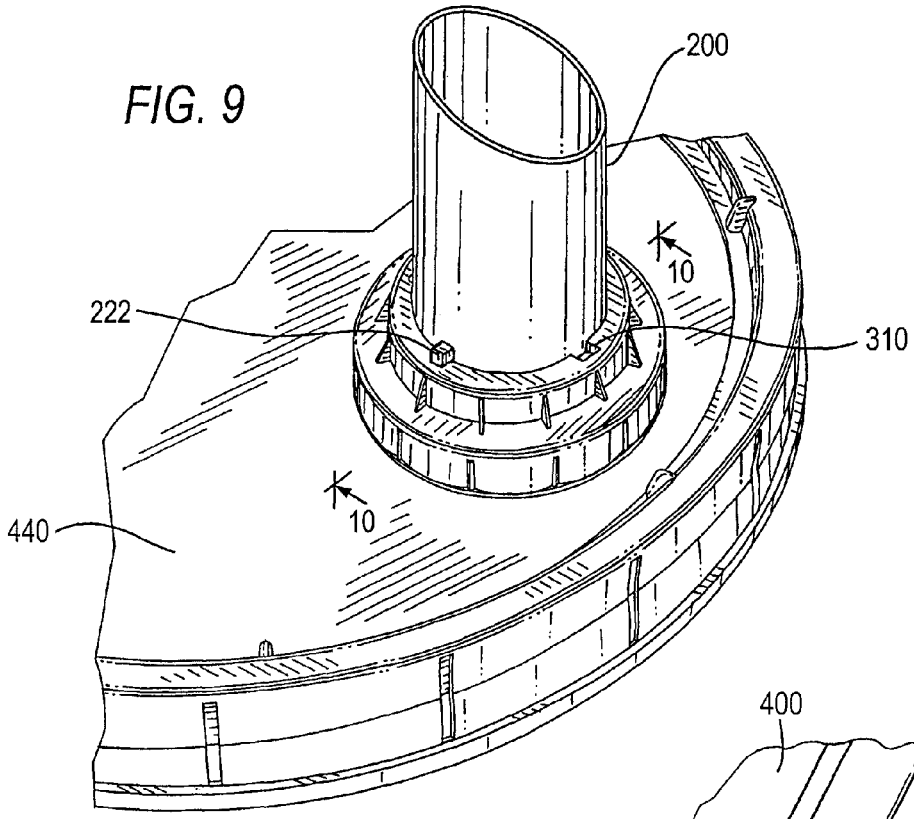
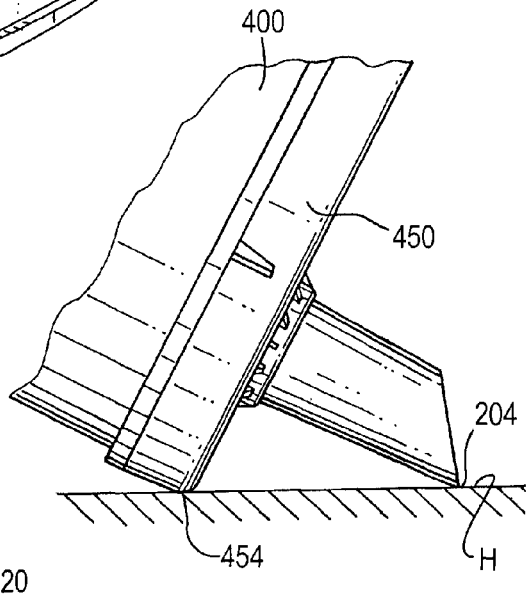
FIG. 11
FIG. 10
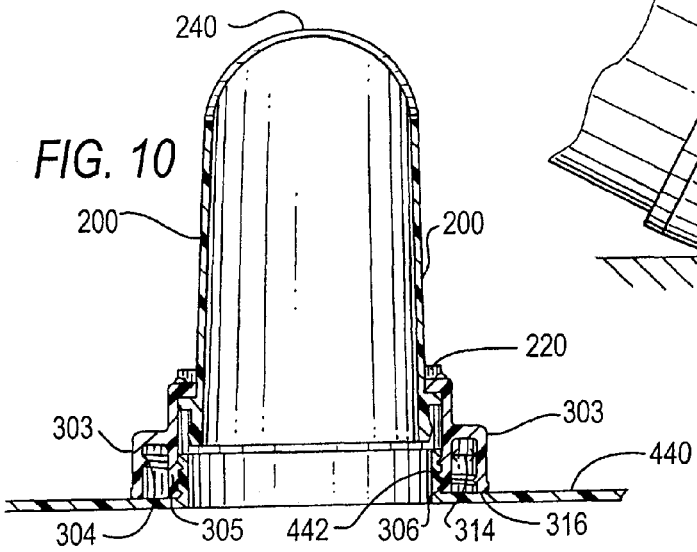

POURING ADAPTOR ASSEMBLY COMPATIBLE WITH MULTIPLE BUCKET LID CONFIGURATIONS

FIELD OF THE INVENTION

The present invention relates to a pouring adaptor assembly to attach to multiple types of bucket lids and to control the flow of a liquid from any one of the bucket lids.

BACKGROUND

Paint buckets, particularly the five gallon variety, may be cumbersome to use because of their size and weight. These buckets are sold with a large generally flat circular lid that includes a smaller circular opening positioned in the lid, near the edge of the lid. In most cases, users pour paint from the large bucket into a smaller paint tray for applying paint to a paint roller. Due to the weight of a paint-filled bucket, when pouring paint from the smaller circular opening it may be difficult to control the timing of paint leaving the bucket as well as the amount of paint leaving the bucket.

A pouring adaptor or spout is useful to control the timing and amount of paint being poured. However, known pouring spouts or adaptors, such as the one illustrated in FIG. 1, require excess parts and are not effective in certain circumstances.

The prior art pouring adaptor of FIG. 1 includes a spout 010, a first adaptor 020, and a second adaptor 030. The spout further includes a connector 012 attached to it. The first adaptor 020 further includes a thread 022 and an opening 024. The second adaptor 030 includes an outer thread 032 and an inner thread 034.

When assembled, the connector 012 of the spout connects to the opening 024. Further, the first adaptor 020 may be connected to the second adaptor 030 by engagement of threads 022 to outer threads 032. The prior art pouring adaptor is limited because the spout 010 is inserted from the top making the spout 010 more likely to be inadvertently removed. Removal of the spout 010 causes paint or liquid from the bucket to run down the side of the bucket and be otherwise difficult to control. Additionally, the prior art pouring adaptor requires a second adaptor 030 in order to connected with a bucket lid opening having a second diameter size.

SUMMARY

A pouring adaptor assembly compatible with any one of multiple bucket lid configurations includes two components—a pouring tube and a threaded adaptor. The pouring tube includes an opening with an angled distal end for steadily pouring a liquid.

Both the pouring tube and the threaded adaptor are separately constructed elements, each of a substantially unitary material. The threaded adaptor includes coaxial threads, namely an inner thread and an outer thread, the two threads being used for connecting to bucket lid openings of varying diameters. The pouring tube includes a tapered lower ridge for snap connecting to a bucket lid having a non-threaded opening.

The pouring tube and the threaded adaptor may be selectively connected to each other in order to attach the pouring tube to a bucket lid having a threaded opening. The pouring tube is inserted into a central opening in the threaded adaptor and secured to an upper locking lip of the threaded adaptor by an interference fit.

BRIEF DESCRIPTION OF THE DRAWINGS

FIG. 1 is an exploded perspective view of a three component prior art pouring adaptor, as previously discussed;

FIG. 2 is an exploded perspective view of an example of the two components of a pouring adaptor assembly of the present invention;

FIG. 9 is a perspective view of the pouring adaptor assembly of FIG. 2, shown engaged to a bucket lid having a relatively small diameter threaded opening;

FIG. 10 is a cross section view thereof, taken along line 10-10 of FIG. 9; and FIG. 11 is a side elevation view of the pouring adaptor assembly of FIG. 2 shown supporting the weight of a paint bucket, without the result of unintentional partial break-away by the adaptor.

DETAILED DESCRIPTION OF THE INVENTION

Figure 3:
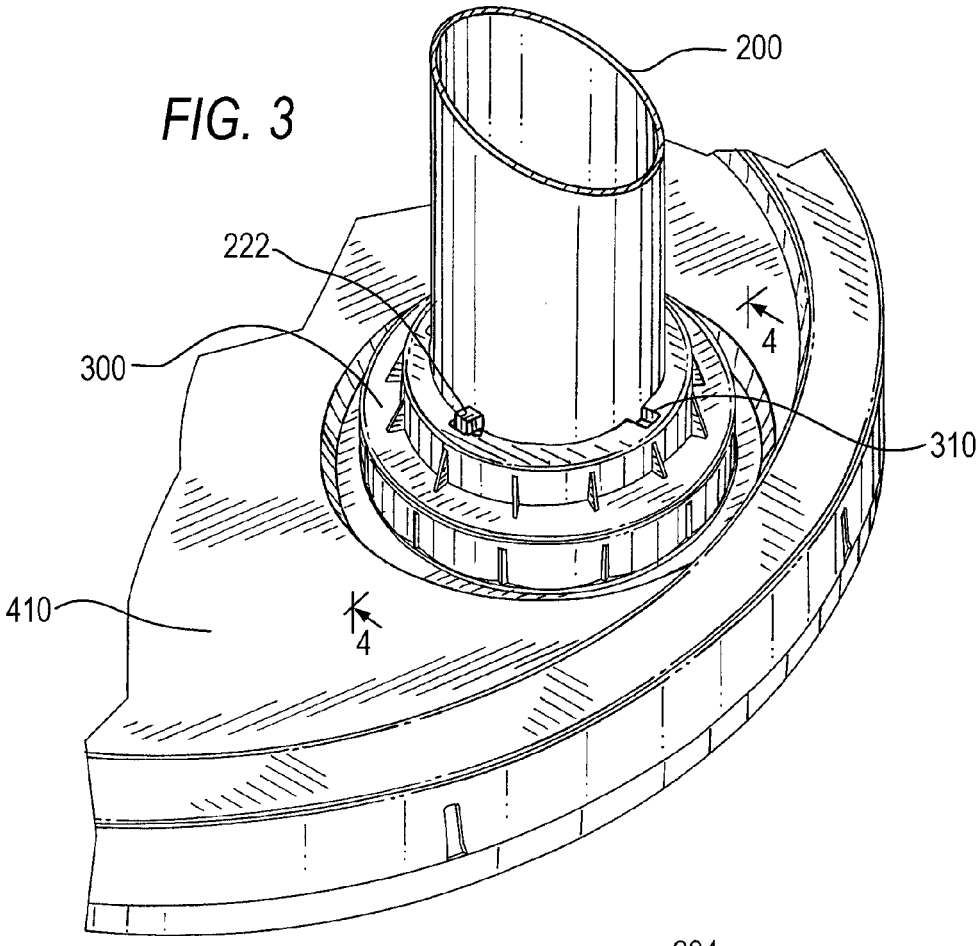
FIG. 3 is a perspective view of the pouring adaptor assembly of FIG. 2, shown engaged to a bucket lid having a relatively large diameter threaded opening.

As illustrated in FIG. 2, a pouring adaptor assembly 100 of the present invention includes a pouring tube 200 and a threaded adaptor 300. Both the pouring tube 200 and the threaded adaptor 300 include respective central openings 202, 302. In the examples shown in FIGS. 3 through 11, these openings 202, 302 are circular, though they may vary in shape. Additionally, the pouring tube 200 preferably has a cross sectional area that corresponds to and snugly fits to the shape of the central opening 302 of the threaded adaptor 300.

Figure 4:
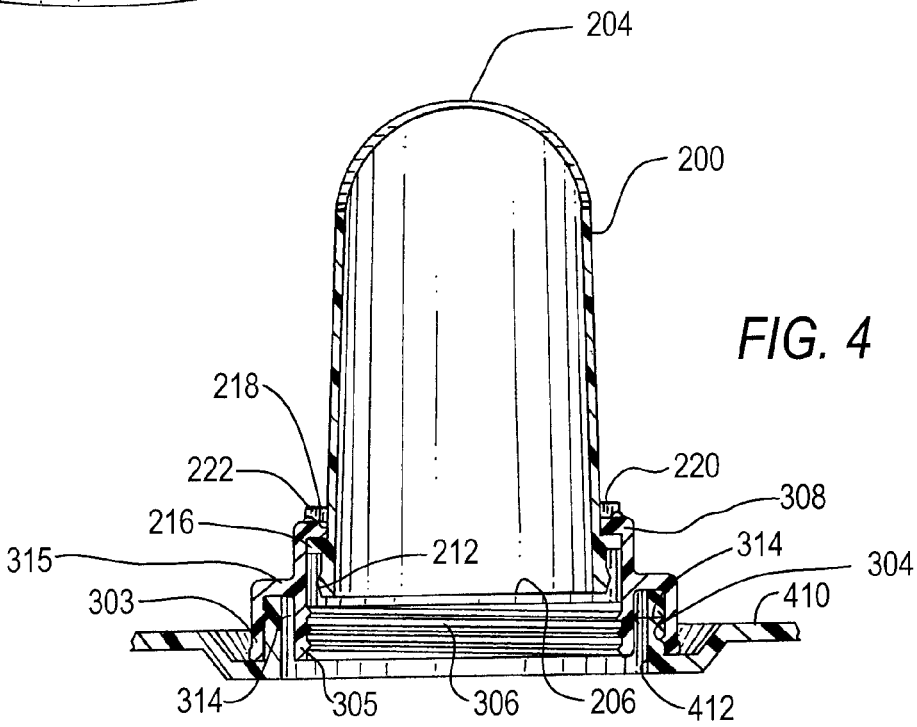
FIG. 4 is a cross section view thereof, taken along line 4-4 of FIG. 3.

As shown in FIGS. 2 through 4, the pouring tube 200 includes a distal end 204 and a proximate end 206, where the distal end 204 has an angled opening 208 for enabling steady and convenient pouring of a liquid. The proximate end 206 of the pouring tube 200 includes a lower external ridge 210 having a tapered surface 212. Above the lower ridge 210 is a gap 214 followed by an upper lip 216. Above the upper lip 216 are a pair of opposed locking extensions 220, 222, separated from the upper lip by a space 218. In the example shown, the lower ridge 210, the gap 214 and the upper lip 216 extend around the circumference of the tube 200 while the locking extensions 220, 222 are limited to two opposite points. Even though two locking extensions 220, 222 are shown in the example, one locking extension or many locking extensions may be employed. The locking extensions 220, 222 are preferably identical projections of material, where locking extension 220 is best shown in the perspective view of FIG. 2.

As illustrated in FIGS. 2 through 4, the threaded adaptor 300 is constructed from a singular element and selectively mates with the pouring spout tube 200. The threaded adaptor 300 includes an outer wall 303 having an outer wall thread 304, an inner wall 305 having an inner wall thread 306, and an upper locking lip 308. The upper locking lip 308 further includes a pair of locking extension openings 310, 312 intended to correspond to the locking extensions 220, 222 of the pouring tube 200. In the example shown, the outer wall 303 and the inner wall 305 are substantially concentric, with the inner wall 305 positioned within the outer wall 303. Further, the outer wall 303 and the inner wall 305 are inseparably fixed together by a horizontal connecting element 315. The outer wall 303 and the inner wall 305 are separated by a circumferential gap 314, which is defined as the space between the outer wall 303, the inner wall 305, and the connecting element 315.

The pouring tube 200 is removeably joined to the threaded adaptor 300 by positioning the pouring tube 200 within the central opening 302 of the threaded adaptor 300. Preferably, the upper locking lip 308 of the threaded adaptor 300 is positioned between the upper lip 216 of the pouring tube 200 and the locking extensions 220, 222 of the pouring tube 200, where the locking extensions 220, 222 extend beyond the width of central opening 302 of the threaded adaptor 300 at the upper locking lip 308. In order connect the pouring tube 200 and the threaded adaptor 300, the distal end 204 of the pouring tube 200 is inserted into the central opening 302 of the threaded adaptor 300 from the threaded adaptor's 300 bottom end 316.

The locking extensions 220, 222 are rotationally positioned to pass through the locking extension openings 310, 312 and are then further rotationally positioned away from the locking extension openings 310, 312 and preferably within a pair of raised stops 318, 320 on the upper surface 322 of the upper locking lip 308. The raised stops 318, 320 are preferably separated by a distance slightly larger than the width of the locking extensions 220, 222. The upper lip 216 of the pouring tube 200 is wider than the central opening 302 of the threaded adaptor 300 at the level of the upper locking lip 308. Thus, the threaded adaptor 300 is held between the upper lip 216 of the pouring tube and the locking extensions 220, 222 of the threaded adaptor.

Figure 7:
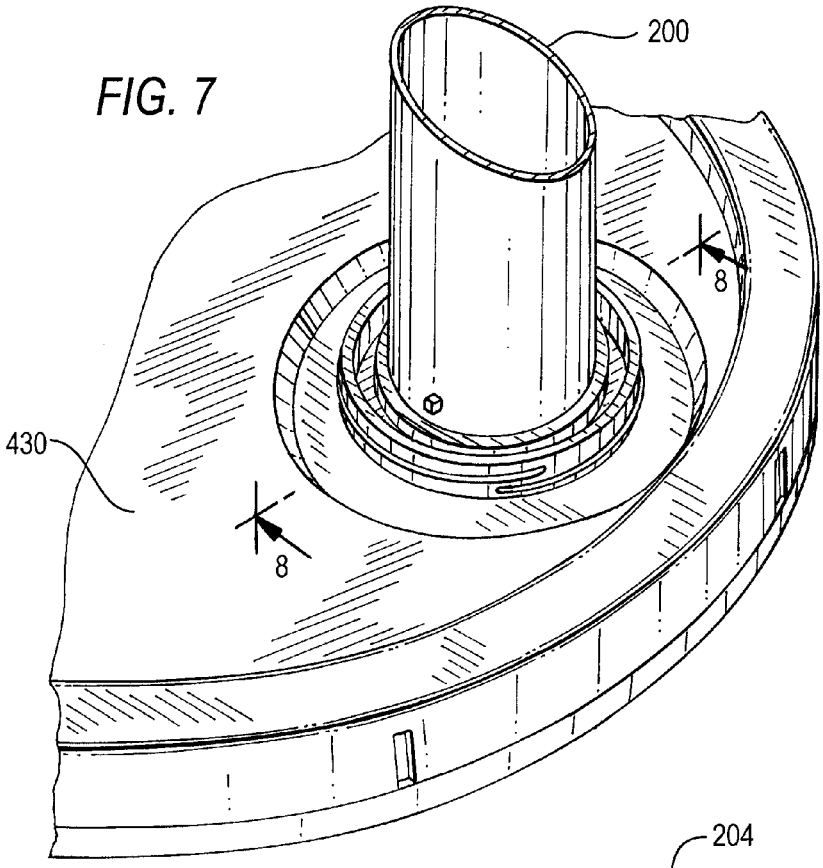
FIG. 7 is a perspective view of the pouring adaptor assembly of FIG. 2, shown engaged to a snap-lock opening of a bucket lid having both a snap-lock opening and a large diameter threaded opening.
Figure 8:
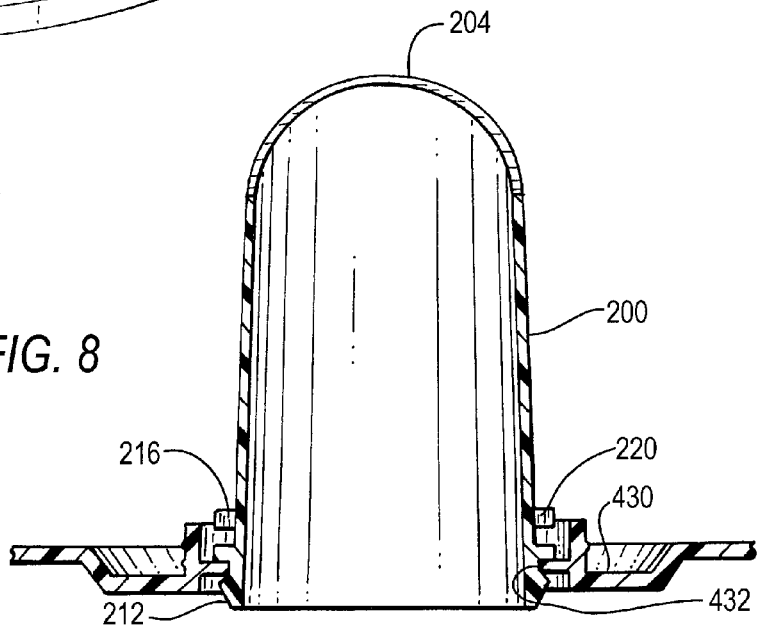
FIG. 8 is a cross section view thereof, taken along line 8-8 of FIG. 7.

The pouring adaptor assembly 100 is designed to connect to at least four different configurations of bucket lids, 410, 420, 430, and 440. Bucket lids, like the ones shown in FIGS. 3 through 10, are commonly used to enclose a five gallon bucket of paint. The lids all include an opening 412, 422, 432, 442 and a lid cap (not shown). In some examples, e.g., the bucket lid 410 of FIGS. 3 and 4 and the bucket lid 440 of FIGS. 9 and 10, the bucket lid openings 412, 442 include screw threads and the corresponding lid cap is attached by a corresponding set of its own threads. In other examples, e.g., the bucket lid 420 of FIGS. 5 and 6, the bucket lid opening 422 includes a snap-fit connection. In the example of FIGS. 7 and 8, the bucket lid opening 432 includes both screw threads and a snap-fit opening. When the pouring adaptor assembly 100 is connected to a bucket lid 410, 420, 430, 440, the assembly 100 allows for more consistent and even pouring of a liquid (e.g., paint).

Referring to FIGS. 3 and 4, a bucket lid 410 includes a relatively large diameter threaded opening 412. In this example, and generally when the assembly 100 is attaching to a threaded opening, the combination of the threaded adaptor 300 and the pouring tube 200 attaches to the lid at the lid 410 opening 412. Specifically, the outer thread 304 of the threaded adaptor 300 is threaded onto the threads of the large diameter threaded opening 412.

Figure 5:
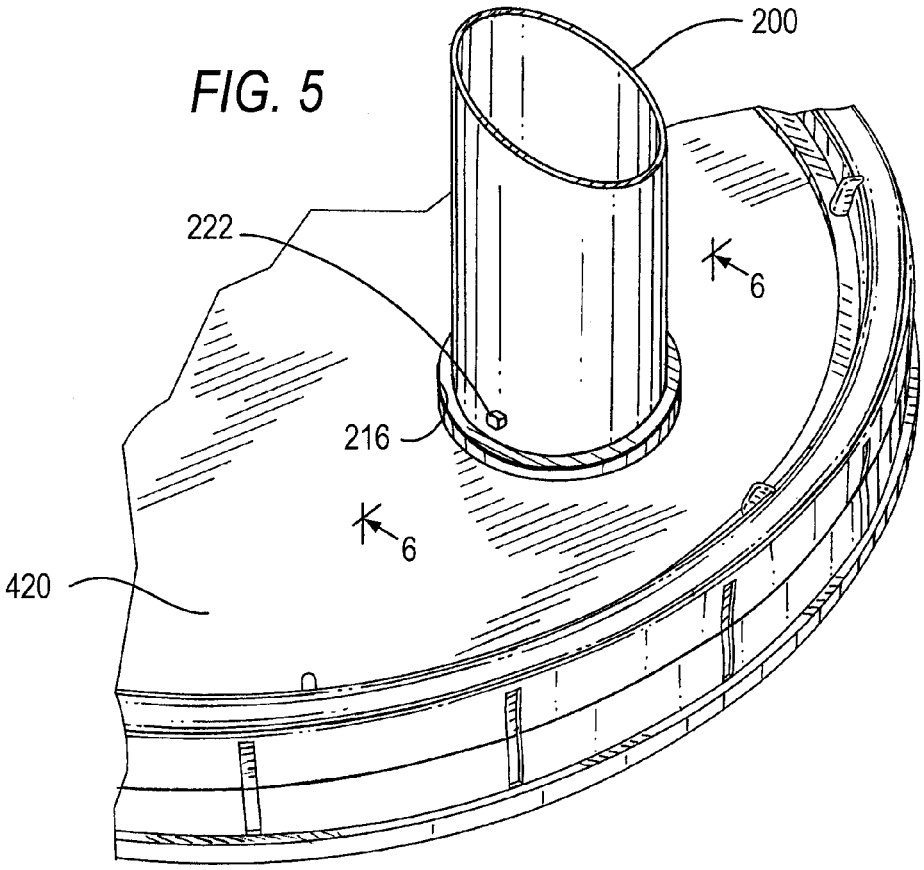
FIG. 5 is a perspective view of the pouring tube of the pouring adaptor assembly of FIG. 2, shown engaged to a bucket lid having a snap-lock opening.
Figure 6:
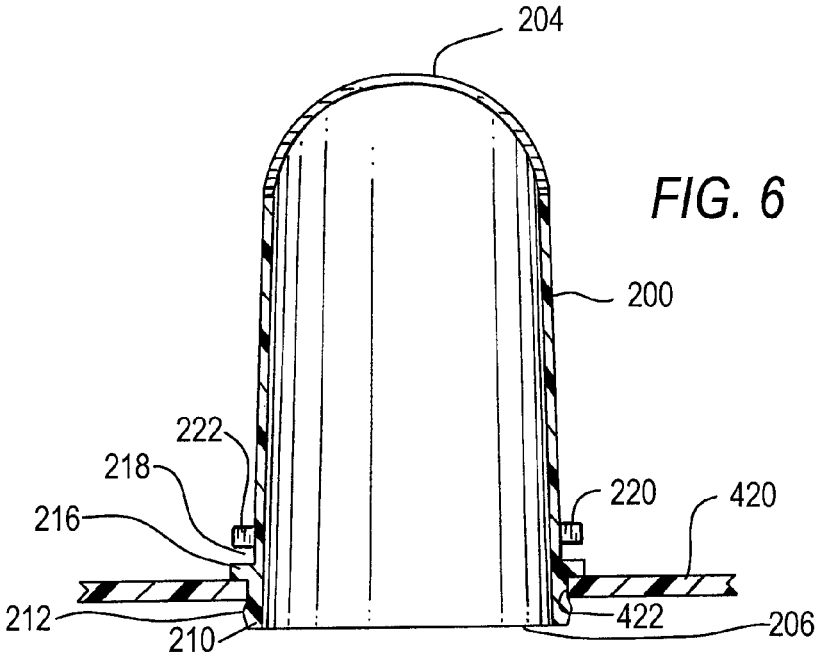
FIG. 6 is a cross section view thereof, taken along line 6-6 of FIG. 5.

As illustrated in FIGS. 5 and 6, a bucket lid 420 includes a snap-fit opening 422. In this example, and generally when the assembly 100 is attaching to a snap-fit opening, the pouring tube 200 is connected to the bucket lid 420 without the threaded adaptor 300. In this example, the pouring tube 200 is positioned within the lid opening 422 where the lower ridge 210 is positioned below the lid 420 and the upper lip 216 is positioned above the lid 420. The taper 212 of the lower ridge 210 in conjunction with the flexibility of both the material of the pouring tube 200 and the material of the bucket lid 420 allow the pouring tube 200 to be connected to the bucket lid 420 by forcing the lower ridge 210 through the lid opening 422, whereupon the lid opening circumference is positioned between lips 210 and 216. Similarly, the pouring tube 200 may be removed from the bucket lid 420 by a strong force.

As shown in FIGS. 7 and 8, a bucket lid 430 includes an opening 432 having both threaded and snap-fit characteristics. In this example, the pouring adaptor assembly 100 may be connected to the bucket lid 430 either by the threaded adaptor 300 or by the lower ridge 210 of the pouring tube 200. The example of FIGS. 7 and 8 shows the latter.

Referring to FIGS. 9 and 10, a bucket lid 440 includes a relatively small diameter threaded opening 442. In this example, the combination of the threaded adaptor 300 and the pouring tube 200 attaches to the lid 440 at the lid opening 442. Specifically, the inner thread 306 of the inner wall 305 of the threaded adaptor 300 is fastened to the relatively small diameter threads of the bucket lid opening 442.

FIG. 11 illustrates the improved against partial or complete removal provided by the pouring adaptor assembly 100 of the present invention. In the illustration, a bucket 400 is positioned on a horizontal surface H and supported by a corner of the bucket lid 454 and by the distal end 204 of the pouring tube 200 of the pouring adaptor assembly 100. As a result of the contact between the bottom 316 of the outer thread 304 of the threaded adaptor 300 and the top of the bucket lid 440, the pouring adaptor assembly 100 will support the weight of the bucket 400, even if the bucket 400 is filled with a liquid.

The accompanying drawings only illustrate exemplary embodiments of a pouring adaptor assembly and their respective constituent parts, however, other types and styles are possible, and the drawings are not intended to be limiting in that regard. Thus, although the description above and accompanying drawings contains much specificity, the details provided should not be construed as limiting the scope of the embodiments but merely as providing illustrations of some of the presently preferred embodiments. The drawings and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. A pouring adaptor assembly for multiple bucket lid configurations, including a bucket lid having a snap-fit opening, a bucket lid having a relatively large diameter threaded opening, a bucket lid having a relatively small diameter threaded opening, and a bucket lid having a combination of a snap-fit opening and a relatively larger diameter threaded opening, the pouring adaptor assembly, comprising:

a pouring tube having a proximal end and a distal end, the pouring tube including:

(a) a ridge extending continuously about a periphery of the pouring tube and tapered inwardly toward the proximal end of the pouring tube such that the ridge is adaptable to be arranged within the snap-fit opening of the bucket lid having said snap-fit opening;

(b) a lip extending continuously about the periphery of the pouring tube and spaced from the ridge to define a gap between the ridge and the lip sized to secure the pouring tube to the bucket lid having the snap-fit opening; and (c) a locking extension protruding from the pouring tube above the lip such that the lip is arranged between the locking extension and the ridge; and a threaded adaptor including:

(a) an inner wall having an inner surface and an outer surface and threading extending about a periphery of the inner surface of the inner wall with the inner wall sized to engage the bucket lid having a relatively small diameter opening;

(b) an outer wall spaced from the inner wall having an inner surface and an outer surface with threading extending about a periphery of the inner surface of the outer wall and the outer wall sized to engage the bucket lid having a relatively large diameter threaded opening; and (c) a locking lip having a recess formed therein that is sized to receive the locking extension with the locking lip sized to fit between the lip of the pouring tube and the locking extension in an assembled state to selectively secure the threaded adaptor to the pouring tube.

2. The pouring adaptor assembly for multiple bucket lid configurations of claim 1, wherein the inner wall and the outer wall of the threaded adaptor are substantially concentric with respect to each other.

3. The pouring adaptor assembly for multiple bucket lid configurations of claim 1, wherein the pouring tube is a cylindrical tube.

4. The pouring adaptor assembly for multiple bucket lid configurations of claim 1, wherein the pouring tube includes two locking extensions.

5. The pouring adaptor assembly for multiple bucket lid configurations of claim 4, wherein the locking extensions protrude in substantially opposite directions from the pouring tube.

6. The pouring adaptor assembly for multiple bucket lid configurations of claim 1, wherein the locking extension is cube shaped.

7. The pouring adaptor assembly for multiple bucket lid configurations of claim 1, wherein the threaded adaptor includes a pair of raised stops adapted to limit the movement of the locking extension of the pouring tube when the pouring tube is connected to the threaded adaptor.

8. The pouring adaptor assembly for multiple bucket lid configurations of claim 1, wherein the distal end of the pouring tube is angled.

9. The pouring adaptor assembly for multiple bucket lid configurations of claim 1, wherein the inner wall and the outer wall of the threaded adaptor are inseparably fixed together by a horizontal connecting element.

10. A pouring adaptor assembly for multiple bucket lid configurations, including a bucket lid having a snap-fit opening, a bucket lid having a relatively large diameter threaded opening, a bucket lid having a relatively small diameter threaded opening, and a bucket lid having a combination of a snap-fit opening and a relatively larger diameter threaded opening, the pouring adaptor assembly comprising:

a pouring tube having a proximal end and a distal end, the pouring tube including:

(a) a ridge extending from the proximal end of the pouring tube;

(b) a lip extending about a periphery of the pouring tube and spaced from the ridge to define a gap between the ridge and the lip sized to secure the pouring tube to the bucket lid having a snap-fit opening; and (c) locking extensions protruding from the pouring tube above the lip in substantially opposite directions; and a threaded adaptor including:

(a) an inner wall having an inner surface and an outer surface and threading extending about a periphery of the inner surface of the inner wall with the inner wall sized to engage the bucket lid having a relatively small diameter opening;

(b) an outer wall spaced from the inner wall having an inner surface and an outer surface with threading extending about a periphery of the inner surface of the outer wall and the outer wall sized to engage the bucket lid having a relatively large diameter threaded opening; and (c) a locking lip having a recess formed therein that is sized to receive the locking extension with the locking lip sized to fit between the lip of the pouring tube and the locking extension in an assembled state to selectively secure the threaded adaptor to the pouring tube.

* * * * *